US005884793A

United States Patent [19]

Wang

[11] Patent Number: 5,884,793

[45] Date of Patent: Mar. 23, 1999

[54] CAP ASSEMBLY FOR A BOTTLE

[76] Inventor: Wen-Pin Wang, No.26,Lane 219,Ta Chuan Nan St., Taichung City, Taiwan

[21] Appl. No.: 14,994

[22] Filed: Jan. 28, 1998

[51] Int. Cl.[6] ..... B65D 25/46

[52] U.S. Cl. ..... 215/389; 215/229; 220/255; 220/259; 220/705; 222/530; 222/536

[58] Field of Search ..... 215/229, 388, 215/389, 387, 235; 220/254, 255, 256, 259, 705, 707, 708, 709, 711, 716, 717; 222/529, 530, 536

[56] References Cited

U.S. PATENT DOCUMENTS

| | | | |
|---|---|---|---|
| 4,440,327 | 4/1984 | Dark | 222/530 |
| 4,560,081 | 12/1985 | Adams | 220/707 X |
| 4,732,303 | 3/1988 | Wang | 222/536 X |
| 4,860,934 | 8/1989 | Komischke | 222/536 X |
| 5,332,131 | 7/1994 | Pehr | 222/536 X |
| 5,346,081 | 9/1994 | Lin | 215/229 |

*Primary Examiner*—Allan N. Shoap
*Assistant Examiner*—Nathan Newhouse
*Attorney, Agent, or Firm*—Rosenberg, Klein & Bilker

[57] ABSTRACT

A cap assembly for a bottle includes a cap member mounted to the bottle and having a top with an opening defined therein. A wall member and a flexible connecting member respectively extend from a periphery defining the opening, the flexible connecting member connected to the wall member so as to define an aperture between a top of the wall member and a top of the connecting member. A tube extends from a periphery defining the aperture. A cover is pivotally and detachably mounted to the cap member such that the tube is pushed by an underside of the cover when the cover is mounted to the cap member and the flexible connecting member is folded downwardly and the aperture is sealed by the downward folded connecting member.

7 Claims, 4 Drawing Sheets

CAP ASSEMBLY FOR A BOTTLE

BACKGROUND OF THE INVENTION

1. Field of the Invention

The present invention relates to a cap assembly and, more particularly, to an improved cap assembly for a bottle and includes a flexible connecting plate from which a tube is connected so that when a cover pivotally connected to the assembly is opened, the tube is pivoted upright because of a biasing force from the connecting plate.

2. Brief Description of the Prior Art

Bottles for water, drink, oil or the like each generally have a cap securely mounted to an open end of the bottle so that the water can be flowed out from the bottle by removing the cap from the open end. However, when the open end of the bottle is tilted, a volume of the water flowing from the open end is difficult to control. In this case, it could become a dangerous result if a kid has to have the water from the open end of the bottle directly. A straw is required for the kid to suck the water, but the straw has to be removed form the bottle if the cap is again mounted to the bottle. Furthermore, if the bottle has viscid liquid received therein such as shampoo, it will be inconvenient for a user to flow the viscid liquid from the bottle simply by tilting the open end. A type of a cap assembly has been developed which has a center tube with a movably sleeve mounted thereto so that when pulling the sleeve upwardly, a passage is defined in the center tube so as to access the water or the like in the bottle and when pushing the sleeve downwardly, the passage is blocked to prevent from leaking. This type of cap assembly needs at least three sets of molds to manufacture the assembly and the molds are expensive.

The present invention intends to provide an improved cap assembly to mitigate and/or obviate the above-mentioned problems.

SUMMARY OF THE INVENTION

In one aspect of the present invention, there is provided a cap assembly for a bottle, comprising a cap member which has a top through which an opening is defined. A wall member and a flexible connecting member respectively extend from a periphery defining the opening. The flexible connecting member is connected to the wall member so as to define an aperture between a top of the wall member and a top of the connecting member so that a tube extends from a periphery defining the aperture. A cover is connected and detachably mounted to the cap member and the tube is pushed by an underside of the cover when the cover is mounted to the cap member while the flexible connecting member is folded downwardly. The aperture is sealed by the downward folded connecting member.

It is an object of the present invention to provide a cap assembly having a tube disposed therein.

It is another object of the present invention to provide a cap assembly having a flexible connecting member which is folded to seal an aperture communicating between the tube and a bottle when the cap assembly is closed.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
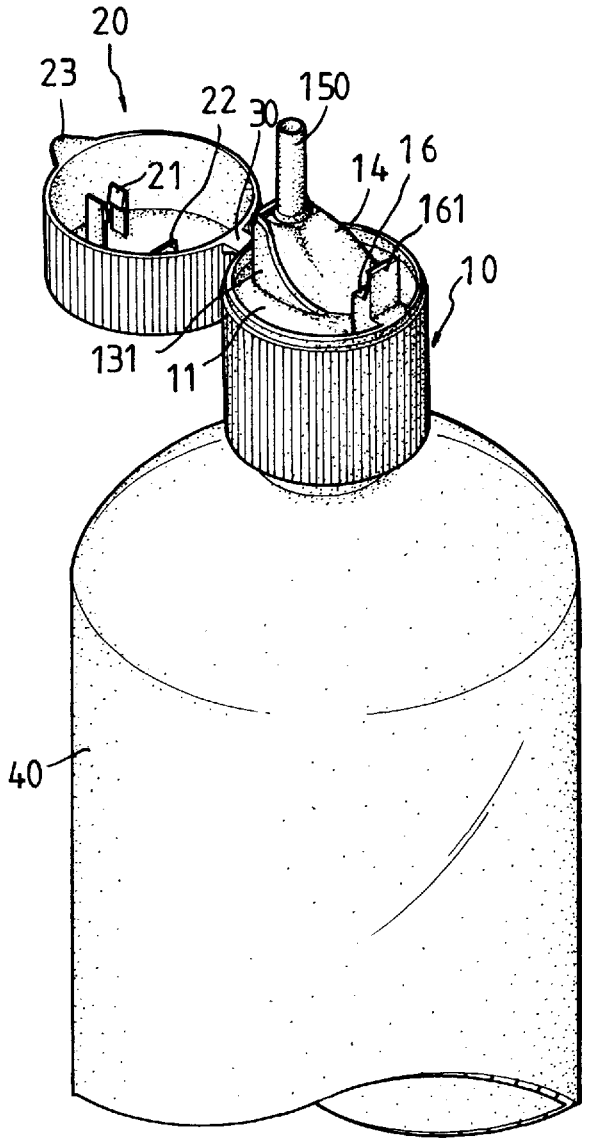
FIG. 1 is a perspective view of a cap assembly in accordance with the present invention mounted to an open end of a bottle.
Figure 2:
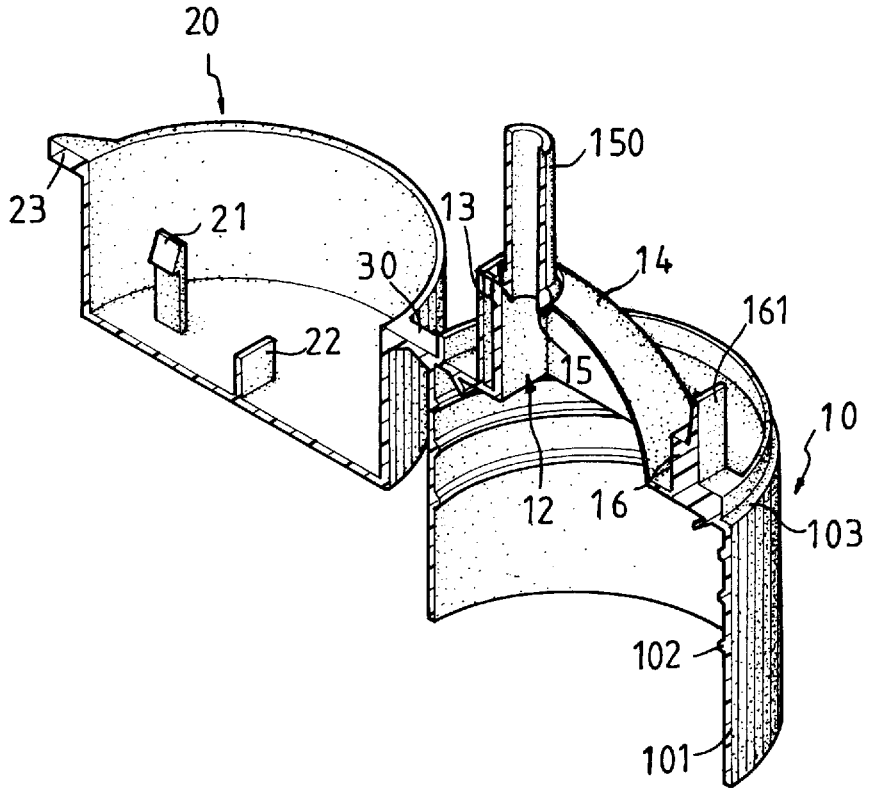
FIG. 2 is a perspective view of the cap assembly, partly being removed, to show when a cover is removed from a cap member of the cap assembly of the present invention.
Figure 3:
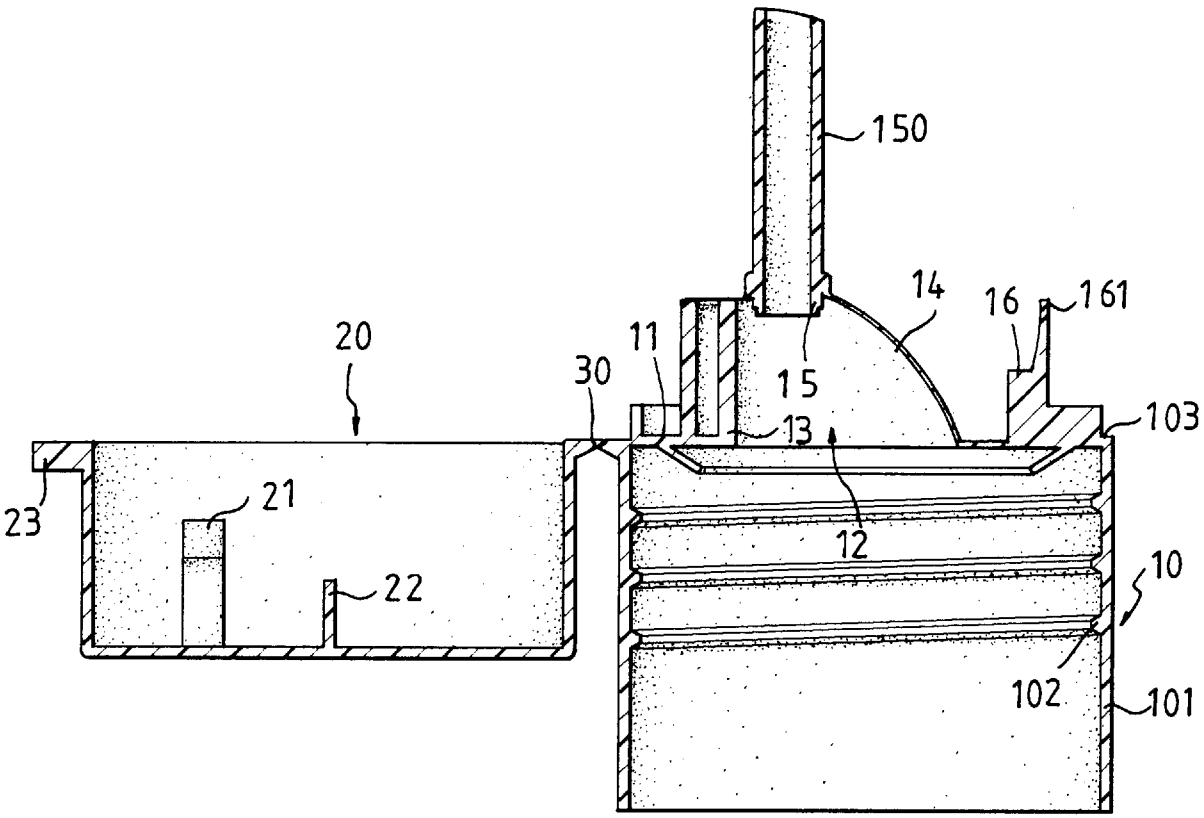
FIG. 3 is a side elevational view, partly in section, of the cap assembly as shown in FIG. 2.

Referring to the drawings and initially to FIGS. 1 through 3, a cap assembly in accordance with the present invention generally includes a cap member 10 and a cover 20 which is connected to the cap member 10 by a plate 30. The cap member 10 has a top 11 through which an opening 12 is defined and a peripheral wall 101 extending from a periphery of the top 11. The peripheral wall 101 has a threaded portion 102 defined in an inner periphery thereof so that the cap member 10 is able to be mounted to a bottle 40. The top 11 of the cap member 10 has a wall member 13 extending perpendicularly from a periphery defining the opening 12 and the wall member 13 has two side walls 131 extending laterally from two opposite sides thereof. A flexible connecting member 14 extends from the periphery defining the opening 12 and is connected between the two side walls 131. An aperture 15 is defined between a top of the wall member 13 and a top of the connecting member 14. A tube 150 extends from a periphery defining the aperture 15. The cap member 10 has a protrusion 16 extending from the top 11 thereof and a stop 161 extends from a top of the protrusion 16.

The cover 20 is detachably mounted to the cap member 10 by a known manner such as a lower periphery of the cover 20 is securely received in a peripheral shoulder portion 103 defined in an outer periphery of the cap member 10. The cover 20 has a lip 23 extending radially and outwardly from the lower periphery thereof. The cover 20 has two pawl members 21 and a plate 22 respectively extending from an underside thereof so that the tube 15 is received between the two pawl members 21 when the cover 20 is mounted to the cap member 10 as shown in FIG. 5.

Figure 5:
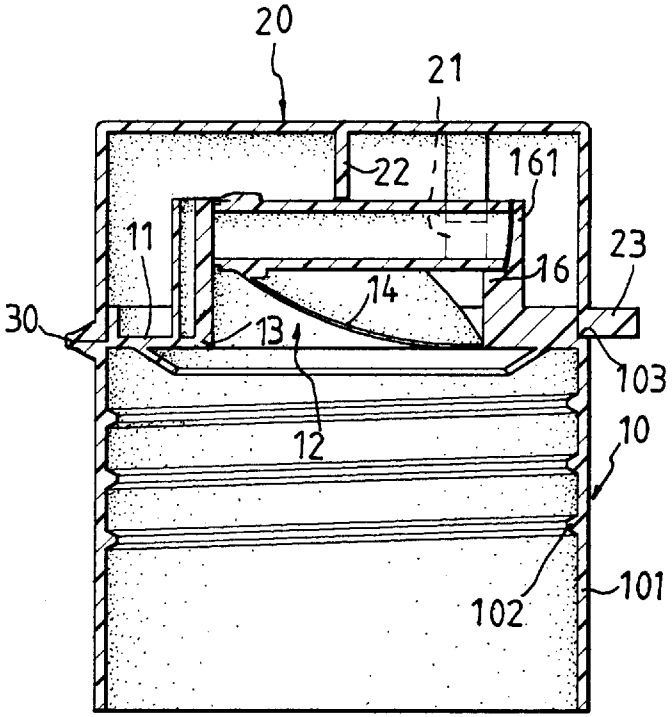
FIG. 5 is a side elevational view, partly in section, of the cap assembly when the cover is completely mounted to the cap member.
Figure 4:
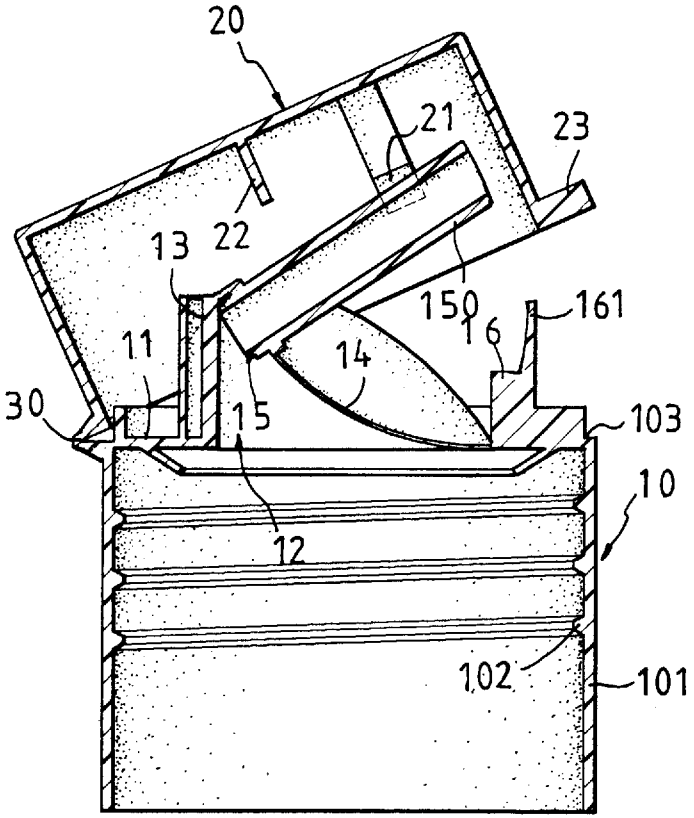
FIG. 4 is a side elevational view, partly in section, of the cap assembly when the cover is to be mounted to the cap member.

Referring to FIGS. 4 and 5, when close the cover 20 to mount on the cap member 10, the tube 150 is pushed by an underside of the cover 20 and the flexible connecting member 14 is folded downwardly so that the aperture 15 is sealed by the downward folded connecting member 14. When the cover is completely mounted to the cap member 10, the tube 150 is clamped between the two pawl members 21 and rested on the protrusion 16 with the plate 22 pressing against the tube 150.

When opening the cover 20 from the cap member 10 by lifting the lip 23, the tube 150 is moved with the cover 20 within the two pawl members 21 till an upright position because the wall member 13, the two pawl members 21 are then disengaged form the tube 150.

Although the invention has been explained in relation to its preferred embodiment, it is to be understood that many other possible modifications and variations can be made without departing from the spirit and scope of the invention as hereinafter claimed.

What is claimed is:

1. A cap assembly for a bottle, comprising:

a cap member being adapted to be mounted to said bottle and having a top through which an opening is defined, a wall member and a flexible connecting member respectively extending from a periphery defining said opening, said flexible connecting member connected to said wall member so as to define an aperture between a top of said wall member and a top of said connecting member, a tube extending from a periphery defining said aperture, and a cylindrical cover connected to said cap member and hingeably mounted to said cap member such that said tube is pushed by an underside of said cover when said cover is mounted to said cap member, and said flexible connecting member is folded downwardly and said aperture is sealed by said downward folded connecting member.

2. The cap assembly as claimed in claim 1 wherein said cover has two pawl members extending from said underside thereof so as to receive said tube between said two pawl members when said cover is mounted to said cap member.

3. The cap assembly as claimed in claim 1 wherein said cover has a plate extending from said underside thereof so as to press against said tube when said cover is mounted to said cap member.

4. The cap assembly as claimed in claim 1 wherein said cover has a lip extending radially and outwardly from a lower periphery thereof.

5. The cap assembly as claimed in claim 1 wherein said cap member has a protrusion extending from said top thereof so that said tube is rested on said protrusion when said tube is pushed by said cover.

6. The cap assembly as claimed in claim 1 wherein said wall member has two side walls respectively extending laterally from two opposite sides thereof and said flexible connecting member is connected between said two side walls.

7. The cap assembly as claimed in claim 1 wherein said cap member has a peripheral wall extending from a periphery of said top of said cap member and said peripheral wall has a threaded portion defined in an inner periphery thereof.

* * * * *